United States Patent [19]

Carter

[11] 3,991,143

[45] Nov. 9, 1976

[54] APPARATUS FOR PRODUCING AND DELIVERING A COMBUSTIBLE FUEL MIXTURE AND IMPROVED NEBULIZER ROTOR

[76] Inventor: Shirley J. Carter, 14902 Purdy St., Midway City, Calif. 92655

[22] Filed: June 7, 1974

[21] Appl. No.: 477,348

Related U.S. Application Data

[63] Continuation-in-part of Ser. No. 378,575, July 12, 1973, abandoned, which is a continuation-in-part of Ser. No. 329,730, Feb. 5, 1973, abandoned.

[52] U.S. Cl. ..... 261/18 A; 261/50 A; 261/88; 261/89; 239/553.3; 239/555

[51] Int. Cl.[2] ..... F02M 7/22; F02M 17/16

[58] Field of Search ..... 239/555, 553.3; 261/88, 261/89, 50 A, 90, 18 A

[56] References Cited

UNITED STATES PATENTS

| | | | |
|---|---|---|---|
| 930,483 | 8/1909 | Kershaw | 261/88 |
| 1,719,869 | 7/1929 | Boyd | 239/555 |
| 2,223,836 | 12/1940 | Snyder | 261/88 |
| 2,595,719 | 5/1952 | Snyder | 261/89 |
| 2,607,574 | 8/1952 | Hession, Jr. | 261/90 |
| 2,636,488 | 4/1953 | Cedarholm | 261/18 A |
| 2,932,495 | 4/1960 | Olson | 261/72 R |
| 3,182,916 | 5/1965 | Schulz | 239/555 |
| 3,197,143 | 7/1965 | Norris | 239/555 |
| 3,322,408 | 5/1967 | Stoltman | 261/50 A |
| 3,701,513 | 10/1972 | Carter | 261/88 |
| 3,875,266 | 4/1975 | Fonagy | 261/50 A |

FOREIGN PATENTS OR APPLICATIONS

| | | | |
|---|---|---|---|
| 562,749 | 11/1923 | France | 261/88 |

*Primary Examiner*—Tim R. Miles
*Attorney, Agent, or Firm*—Herzig & Walsh, Inc.

[57] ABSTRACT

Apparatus including a mixing chamber has a hollow rotor mounted therein carrying a stack of tightly pressed together nebulizer rings made of pliant material characterized by having substantially constant dimensions. A selected gas, such as air, is supplied to the mixing bowl while liquid fuel and optionally water or other liquid additives are metered into the interior of the hollow rotor at a rate controlled as a function of the air flow into the chamber. The fuel and water are each nebulized and uniformly dispersed into the mixing chamber by being propelled by centrifugal force generated by the rotor between the smooth uniform laminae defined by the pressed together nebulizer rings. The rotor is preferably driven to operate as a Van de Graaf generator and the nebulizer rings are preferably made up of dielectric materials to induce substantial electrostatic charges on liquids propelled therebetween.

10 Claims, 15 Drawing Figures

FIG.11
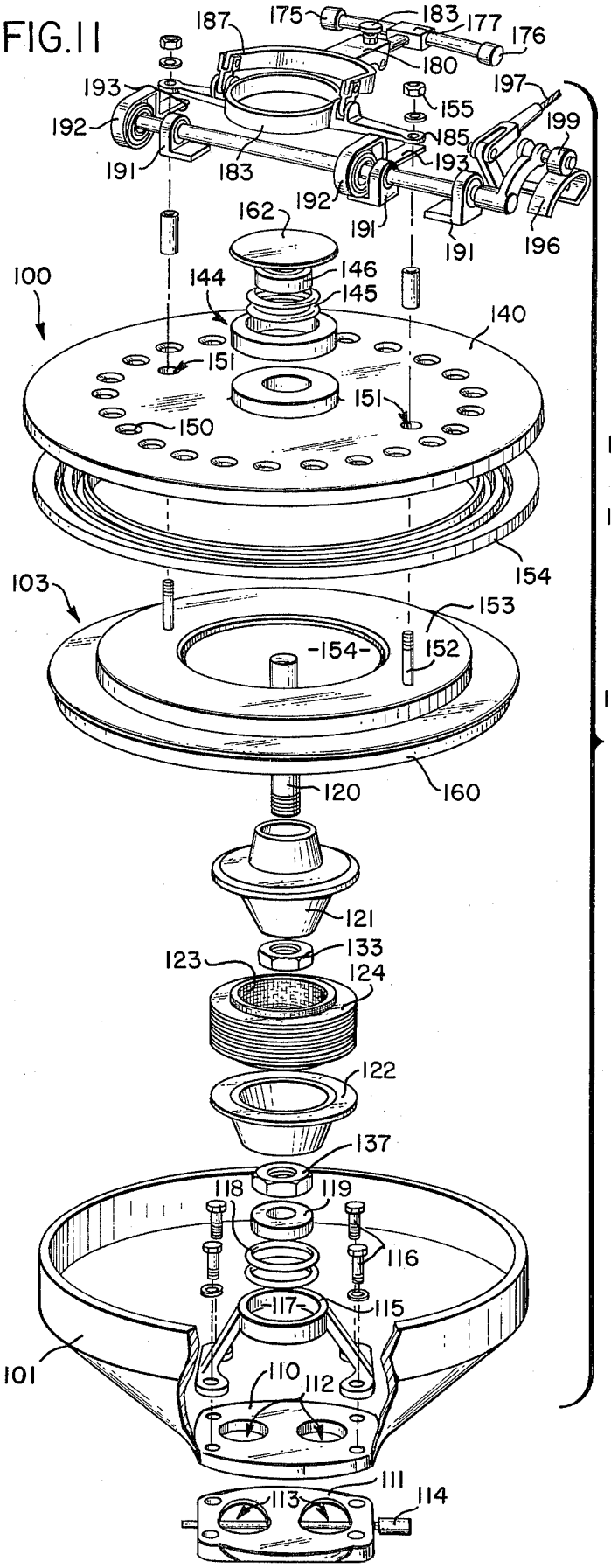
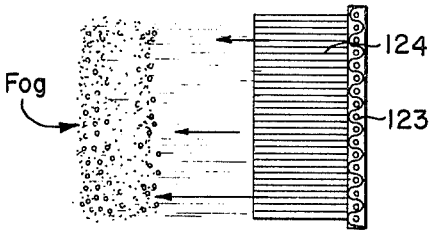
FIG.13
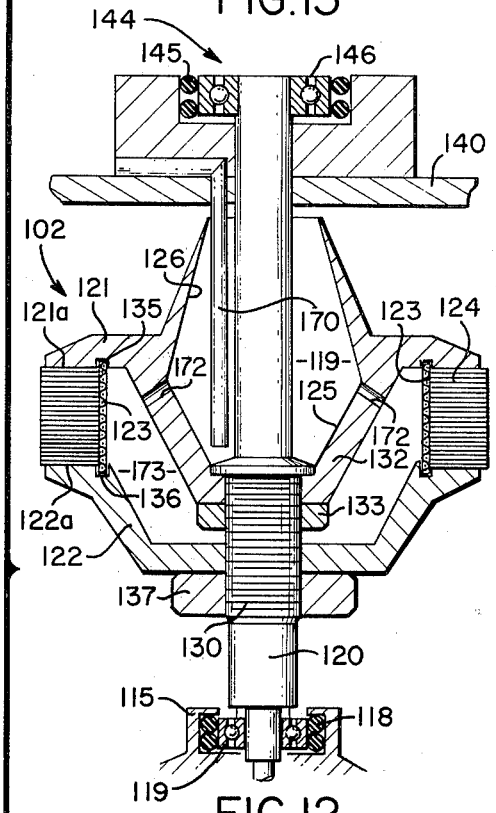
FIG.12
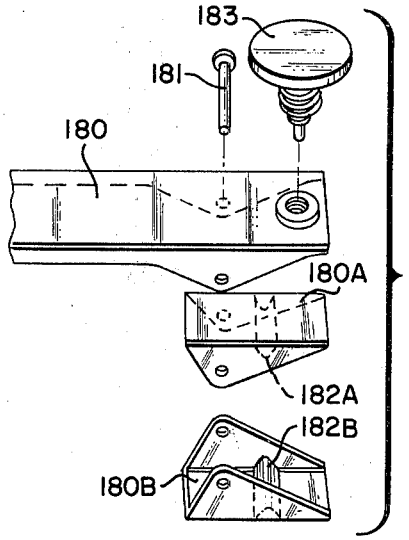
FIG.14

APPARATUS FOR PRODUCING AND DELIVERING A COMBUSTIBLE FUEL MIXTURE AND IMPROVED NEBULIZER ROTOR

RELATED APPLICATIONS

This application is a continuation in part of my copending application Ser. No. 378,575 filed 12 July 1973 now abandoned, which application in turn was a continuation in part of copending application Ser. No. 329,730 filed 5 Feb. 1973 and also abandoned.

BACKGROUND OF THE INVENTION

The present invention relates to the nebulization of liquids and the production of burnable fuel mixtures of delivery to internal combustion engines and the like. More particularly, the present invention relates to an improved nebulizer rotor and an improved apparatus capable of producing a substantially homogenous combustible mixture comprised of nebulized particles of fuel, water and/or other suitable additives suspended in a suitable gas, such as air.

As used herein, the term nebulized refers to reduction of a liquid to minute particles or a fine spray or mist. Nebulized drops, for example, are classified on a chart entitled Characteristics of Particles and Particle Dispersoids in the Stanford Research Institute Journal, Third Quarter 1961, as particles having a diameter in the range of 1 to 20 microns.

In addition to my prior U.S. Pat. No. 3,701,513 issued 31 Oct. 1972, over which the present invention constitutes an improvement, the below-listed patents have been called to my attention by the U.S. Patent Office in the related applications hereinbefore identified.

| COUNTRY | PATENT NO. | INVENTOR | DATE PATENTED |
|---|---|---|---|
| U.S.A. | 930,483 | Kershaw | 10 August 1909 |
| *France | 562,749 | Cugnin | 27 February 1923 |
| U.S.A. | 1,515,766 | Astren | 18 Novemeber 1924 |
| *U.S.A. | 1,719,869 | Boyd | 9 July 1929 |
| U.S.A. | 2,223,836 | Snyder | 3 December 1940 |
| U.S.A. | 2,595,719 | Snyder | 6 May 1952 |
| U.S.A. | 2,636,488 | Cedarholm | 28 April 1953 |
| U.S.A. | 2,932,495 | Olson | 12 April 1960 |
| U.S.A. | 3,375,058 | Petersen, et al. | 26 March 1968 |
| U.S.A. | 3,615,054 | Botz | 26 October 1971 |
| U.S.A. | 3,672,293 | Gona, et al. | 27 June 1972 |
| U.S.A. | 3,875,266 | Fonagy | 1 April 1975 |

Of these patents, the two marked with an asterisk, i.e., Cugnin and Boyd, are of particular interest. While the devices disclosed therein are generally relevant, the disclosure of these patents is not adequate to teach one skilled in the art how to construct a device capable of operating with the efficiency characteristic of my invention. For example, I have found that the use of a loosely arranged stack of rings as suggested by Boyd in describing his arrangement is totally unsatisfactory. As stated in each of my related applications, I have found that the stack of laminae carried by the hollow rotor in the embodiments of apparatus hereinafter described as the preferred embodiments should be pressed together tightly.

Further, it is noted that the nature and character of the material making up the rings of the devices of the Boyd and Cugnin patents is neither described nor suggested in these patents. These features are of importance and significance.

SUMMARY OF THE INVENTION

It is an object of the present invention to provide an improved apparatus for producing a substantially homogenous combustible mixture comprised of nebulized fluid in a suitable gas. The uniformity of such a mixture of air with small fuel droplets is of paramount importance with liquid commercial fuels having a range of stoichiometric air fuel ratios between 14.4 to 15.2 and with an engine's lean misfire air to fuel ratio limit about 17.1.

It is further an object of the present invention to provide an improved apparatus as set forth employing a hollow rotor mounted in a mixing bowl or chamber, the hollow rotor carrying a stack of tightly pressed together nebulizer rings made of pliant material characterized by having substantially constant dimensions which define smooth uniform laminae when pressed together.

It is also an object of the present invention to provide an improved apparatus for producing a substantially homogenous extremely lean combustible fuel mixture for powering internal combustion engines which is effective to substantially increase gas mileage and significantly reduce pollution.

It is additionally an object of the present invention to provide an improved rotor apparatus for nebulizing liquids by the use of centrifugal force.

It is yet another object of the present invention to provide an improved rotor apparatus as set forth which carries a stack of tightly pressed together nebulizer rings made up of pliant materiial characterized by having substantially constant dimensions which define smooth uniform laminae when pressed together.

It is further an object of the present invention to provide a method of nebulizing liquids by propelling the liquids through the use of centrifugal force between layers of tightly pressed together pliant material characterized by having substantially constant dimensions which define smooth uniform laminae when pressed together.

It is still another object of the present invention to provide a method of homogenously suspending nebulized drops of liquid in a confined quantity of a gas by propelling the liquids between layers of dielectric materials so as to cause electric charges to be generated on the nebulized liquid drops which electrical charges operate to repel the drops from each other so that they assume a homogenous distribution in the confined quantity of gas.

In accomplishing these and other objects, there is provided apparatus including a mixing chamber having a hollow rotor mounted therein. The hollow rotor carries a stack of tightly pressed together nebulizer rings made up of pliant material characterized by having substantially constant dimensions. A selected gas, such as air, is supplied to the mixing bowl while liquid fuel and optionally water or other liquid additives are metered into the interior of the hollow rotor at a rate controlled as a function of the air flow into the chamber or bowl. The fuel and water are each nebulized and uniformly dispersed into the mixing chamber by being propelled by centrifugal force generated by the rotor between the smooth uniform laminae defined by the pressed together nebulizer rings. The rotor is preferably driven to operate as a Van de Graaf generator and the nebulizer rings are preferably made up of dielectric materials to induce substantial electrostatic charges on liquids propelled therebetween.

Additional objects reside in the specifid construction of the embodiments of the present invention hereinafter described and their methods of operation.

BRIEF DESCRIPTION OF THE DRAWINGS

FIG. 11 is an exploded view in perspective of the apparatus of FIG. 5.

FIG. 12 is a cross-sectional view of the rotor portion of the apparatus of FIG. 5 illustrating the manner it is mounted therein.

FIG. 13 is a cross-sectional elevation view of part of the stack of nebulizer rings carried by the rotor of the apparatus of FIG. 5 illustrating nebulization of liquid thereby.

FIG. 14 is an exploded view of the pinch valve arrangement shown in cross-section in FIGS. 8A and 8B.

DETAILED DESCRIPTION OF THE PREFERRED EMBODIMENTS

Figure 1:
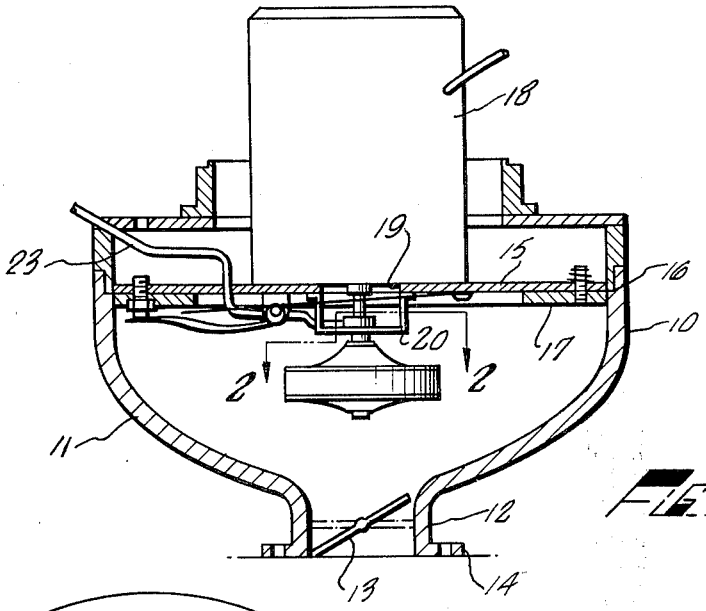
FIG. 1 is a drawing partly in section of a device embodying the present invention.
Figure 2:
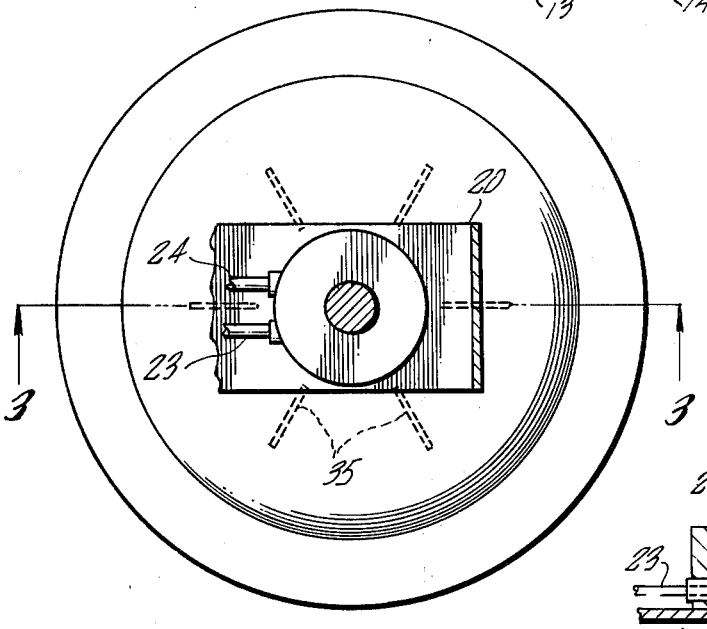
FIG. 2 is a section taken along the line 2—2 of FIG. 1.

Referring now more particularly to FIGS. 1–4 of the drawings, the fuel feeding apparatus 10 therein disclosed is provided with a shell 11 having a reduced outlet section 12 controlled by butterfly valve 13. Reduced section 12 has a flange 14 for mounting like a carburetor on the intake manifold of an engine.

A plate 15 rests upon a shoulder 16 on the upper interior of the shell of bowl 11. This plate 15 is identical with plate 35 of my prior Patent and is provided with a series of holes (not shown) which provide air passages and are closed by a flapper valve 17 identical with the flapper valve 40 of my prior Patent. An electric motor 18 rests on plate 15 with its drive shaft extending through a central opening 19 in plate 15.

A bracket 20 hangs down from plate 15 and supports a T-shaped bearing retainer 21 with a shank of the retainer extending through an opening 22 in the bracket. A pair of flexible hoses 23 and 24, respectively, supply water and fuel through bores in the retainer 21 to the liquid retrieving chamber 25 of rotor 26.

A bearing 17 from the shaft 28 of motor 18 is carried in the bearing retainer 21. Shaft 28 is threaded adjacent to its lower end to receive a nut 29, which serves to hold the rotor on shaft 28 and to compact the hereinafter described laminations.

The rotor 26 is comprised of an upper part 30, a lower part 31 and a central part 32. The central part 32 comprises a plurality of very thin ring-shaped laminations of material (see FIG. 4). Downwardly and radially directed passages 35 communicate the liquid receiving chamber 25 to the space 36 formed by the interior of rings 33 and 34. A screen 37 is located on the inner edges of rings 33 and 34.

As above-mentioned, the nut 29 is tightened on the shaft 28 to compact and tightly press together the laminations 32. Preferably, the nut 29 is tightened as tightly as can be done without stripping the associated threads on the shaft 28, such as to an average pressure of 700 p.s.i. on the surfaces of the pressed together laminae.

A pair of screws 38 and 39 extend through bores in the upper part 30 of rotor 26 and into tapped holes in a plate 40 integral with shaft 28.

The operation of the above-described device shown in FIGS. 1–4 is as follows.

When the motor 18 is energized by the battery (not shown), it drives the rotor at a fixed rate of from 3,000 to 5,000 r.p.m. Water, other additives, and fuel pass through the passages 35 into space 36. The centrifugal force generated by rotating the rotor 26 at this rate causes the mixture of fuel and water to force its way between the laminations from which it emerges as a very fine mist of low micron sized particles. Such mixture is again mixed with air and passes through butterfly valve 13 into the intake manifold of an engine.

Figure 4:
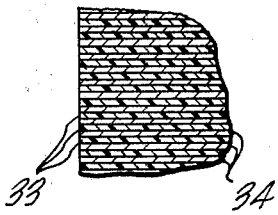
FIG. 4 is an enlarged, fragmentary section taken along the line 4—4 of FIG. 3 which illustrates the laminar construction of the rotor wall.
Figure 3:
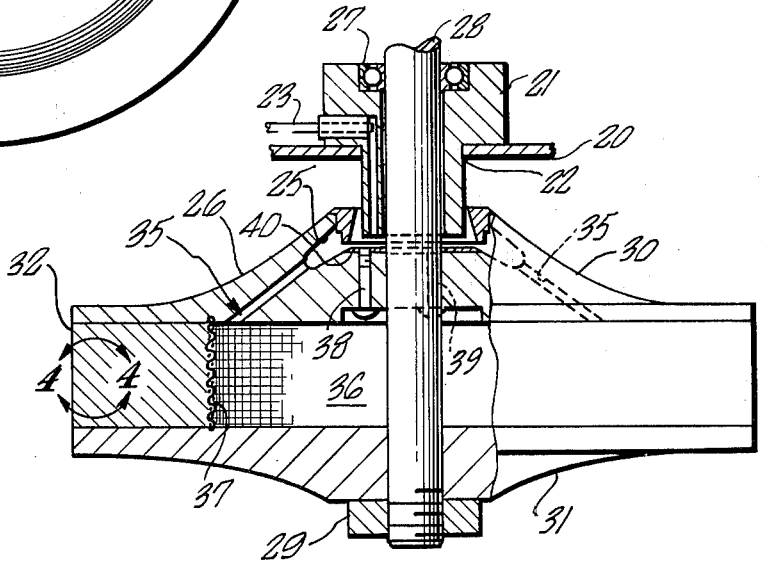
FIG. 3 is a section taken along the line 3—3 of FIG. 2.

In the foregoing specification, the laminations are referred to as being made of material. The preferred material is alternate layers of very thin paper material, such as glassine, and very thin sheets of polyethylene terephthalate (mylar) as shown in FIG. 4. These materials have dielectric properties such as to impart to the individual particles which pass between them uniform like charges causing the particles to repel each other and to prevent their coalescing. However, other materials may be used. For example, thin sheets of aluminum may be used since they are pliable like paper, have substantially constant dimensions under pressure and can be pressed to form flat, smooth uniform laminae. Since aluminum is an electrical conductor instead of a dielectric, it is believed that not as much electrostatic charge will be generated on droplets of liquids nebulized thereby. What is necessary is to have smooth, pliant thin rings which are substantially noncompressible and do not absorb liquids being nebulized so as not to change in size such as due to swelling during rotor operation, thereby to provide smooth uniform laminae when the rings are tightly pressed together.

It is noted that it has been found by experimentation that if the thin rings are not tightly and uniformly pressed together so as to be held flat and smooth that nonuniform droplets will result and the device will consequently not produce a homogenous mixture. Further, it is noted that by making the thin rings of dielectric materials, that is to say of materials that are substantially electrically nonconductive, that substantial and uniform electrical charges are generated on the nebulized droplets produced as a result of the friction between the dielectric materials and the selected liquids. As a result of these electrostatic changes, the nebulized droplets repel each other so as to assume a substantially homogenous distribution in a mass or quantity of gas into which they are injected. Thus, a suspension of nebulized low micron size droplets is formed which does not wet out or tend to cluster together.

It is noted that apparatus 10 is effective to produce highly combustible lean fuel mixtures even when low fuel stock, such as kerosene, fuel oil or low octane gasoline, is used.

Referring now to drawing FIGS. 5–13, another embodiment of fuel feed apparatus or nebulizer is there shown which is generally identified by the numeral 100. The fuel feed apparatus 100 is made up of a fuel mixing bowl 101, a nebulizer rotor portion 102, an impact diaphragm means 103 for controlling airflow, and a drive motor 104.

The mixing bowl 101 is formed symetrically about a central axis and narrows from top to bottom to form a fuel mixture outlet port centrally in its bottom portion. The fuel outlet is illustrated as being defined by a mounting plate 110. As shown in FIG. 11, the mounting plate 110 is arranged for bolting like a carburetor on a conventional butterfly valve arrangement 111. The butterfly valve 111 shown is of the type conventionally used with a dual throat carburetor and operates to control the rate which fuel mixture is supplied to the intake manifold of an internal combustion engine (not shown). Outlet ports 112 are formed in the mounting plate 110 in appropriate locations for communication with the dual ports 113 of the butterfly valve 111. The opening and closing of the dual ports 113 is controlled in a conventional manner through linkage 114 which is connected to the engine throttle or accelerator (not shown).

Figure 5:
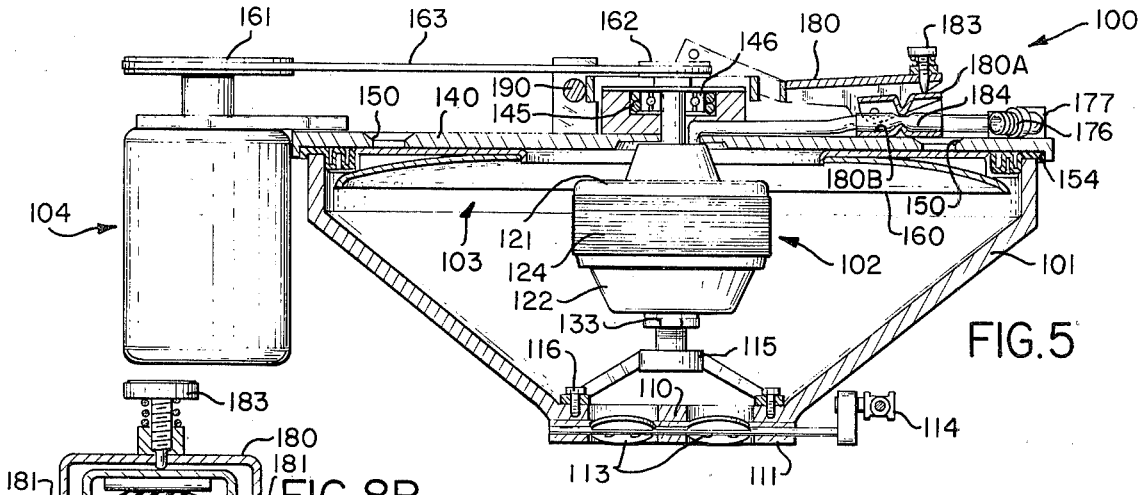
FIG. 5 is an elevation view partially in cross-section of another embodiment of apparatus according to the present invention.

As shown in FIGS. 5 and 11, support structure 115 is bolted by bolts 116 to the upper side of the mounting plate 110. The structure 115 is constructed for supporting the lower end of the shaft 120 of the nebulizer rotor 102 and defines an annular opening 117 into which is fitted an electrically nonconductive, preferably rubber, elastic insulator 118. The insulator ring 118 is connected to hold annular bearing member 119, as shown in FIG. 12. it is noted by making the insulating ring 118 elastic that it also functions to absorb wobbling movement of the rotor 102 during its operation.

Referring now to FIGS. 5 and 11–13, the construction of the nebulizer rotor 102 is there shown. The rotor 102 is made up of the central shaft 120 abovementioned, hollow upper and lower rotor portions 121 and 122, a cylindrical screen 123, and a stack of thin pliable nebulizer rings 124. The stack of nebulizer rings 124 may contain a thousand or more of these rings which are extremely thin, such as in the range of 0.0005 to 0.0012 inches thick. The rings 124 are made of selected materials which do not shrink, swell, expand, compress or otherwise change dimension during operation of the nebulizer rotor 102. Further, the thin layers of material from which the rings 124 are made should be pliable like paper so as to form extremely smooth laminae when flattened by being pressed together. Additionally, the material or materials from which the rings 124 are formed should be appropriately selected to be materials which are not deteriorated by the liquids they are used to nebulize.

As shown particularly in FIG. 12, the central rotor shaft 120 has a threaded portion 130 with a radially extending flange 131 located just above the threaded portion 130. The upper rotor section 121 opens upwardly to form a liquid receiving chamber or cavity 119 around the shaft 120 and has a collar portion 132 formed on its lower end. A central opening sized to receive the threaded portion 130 of the rotor shaft 120 is formed in the collar 132. Thereby, the rotor upper portion 121 may be symmetrically mounted for rotation on the shaft 120 by sliding the collar 132 upwardly around the shaft 120 until it abuts against the radial flange 131. A nut 133 is then threaded on the threads 130 and tightened against the lower side of the collar 132 to fixedly mount the upper rotor portion 121 in place as shown in FIG. 12.

The liquid receiving chamber 119 is illustrated formed as an upwardly opening chamber made up of two conical surfaces 125 and 126. The conical surface 125 slopes upwardly and outwardly from the flange 131 and the flange 131 slopes downwardly to the surface 125. The conical surface 126 slopes upwardly and inwardly from the upper edge of the surface 125 towards the shaft 120. The upper edge of the surface 126 stops short of the shaft 120 to allow space for a delivery tube to extend downwardly into the chamber 119.

The cylindrical screen 123, which is preferably metal, is secured in an annular groove 135 formed in the lower surface of the radially extending flange portion 121A of the rotor portion 121. The screen 123 is positioned to define a cylindrical surface for holding the nebulizing rings 124 centered concentrically around the shaft 120 during high speed rotation of the rotor 102. The lower rotor portion 122 has a central opening formed therein for fitting around and receiving the threaded portion 130 of the shaft 120. As shown in FIG. 12, the lower rotor portion 122 is slid upwardly on the shaft 120 and has a radially extending flange portion 122A positioned for bearing against the lower end of the stack of nebulizer rings 124. It is noted that flange portions 121A and 122A define downward and upward facing planar surfaces, respectively, which are mutually parallel and perpendicular to the rotor shaft 120. An annular groove 136 is formed in the flange 122A for receiving the lower end of the screen 123. The depth of the groove 136 is sufficient so that the lower end of the screen 123 does not touch the bottom of the groove. Thereby, the lower rotor portion 122 may be tightened against the stack of nebulizing rings 124 to tightly press these rings together and the screen 123 will not buckle during this tightening operation.

A cover plate 140 is secured on the top of the mixing bowl 101. Centrally formed on the cover plate 140 to define a cylindrical opening 141 therein is a collar portion 142. The upper end of the rotor shaft 120 extends upwardly through the opening 141. Mounted by being bolted by bolts 143 on the cover plate 140 is bearing means 144 for rotatably supporting the upper end of the rotor shaft 120. The bearing means 144 is made up of an annular elastic insulating ring 145 and an annular bearing member 146. The insulating ring 145 and bearing member 146 are made in substantially the same manner as those in the bearing means mounted within the lower rotor support structure 115.

The cover plate 140 has a series of circular air holes 150 formed to define a circle concentric with its central axis. The holes 150 are preferably equally spaced apart circumferentially and are located from the center point of the cover plate a distance approximately equal to three-quarters of the radius of the cover plate. Formed within the circle defined by the series of holes 150 are diametrically spaced apart guide openings 151. The guide openings 151 are designed for receiving vertically extending guide posts or shafts 152 which are mounted on the upper surface of an air impact diaphragm 153. The impact diaphragm 153 is part of the aforementioned airflow control means 103 and has a central opening 154 formed therein.

An annular shaped bellows-like member 154 is secured around the outer edge of the impact diaphragm 153. The outer edge of the bellows member 154 is clamped between the upper edge of the bowl 101 and the lower surface of the bowl cover plate 140 and defines an air-tight seal therebetween. The impact diaphragm 153 is shown mounted in situ in FIG. 5 and forms a floating damper plate which closes the air holes 150 when biased in its upper position, as shown in FIG. 5, and which as it is moved downwardly defines an air passage from the holes 150 through its central opening 154 into the mixing bowl 101, as indicated by arrows in FIG. 7. The bellows 154 functions to permit the air impact diaphragm plate 153 to move freely up and down.

It is noted that the area of the impact plate 153, its central opening 154 and the mixing bowl outlet 112 should be designed so that the diaphragm plate 153 does not tend to hunt for an equilibrium position during operation of the apparatus 100.

Outwardly and downwardly curving air flow control structure 160 is illustrated secured by the upwardly extending shafts 152 on the lower side of the impact diaphragm 153. The structure 160 functions to direct or turn air flowing into the mixing bowl 101 through the opening 154 in a downward direction for discharge out the bowl ports 112.

Figure 6:
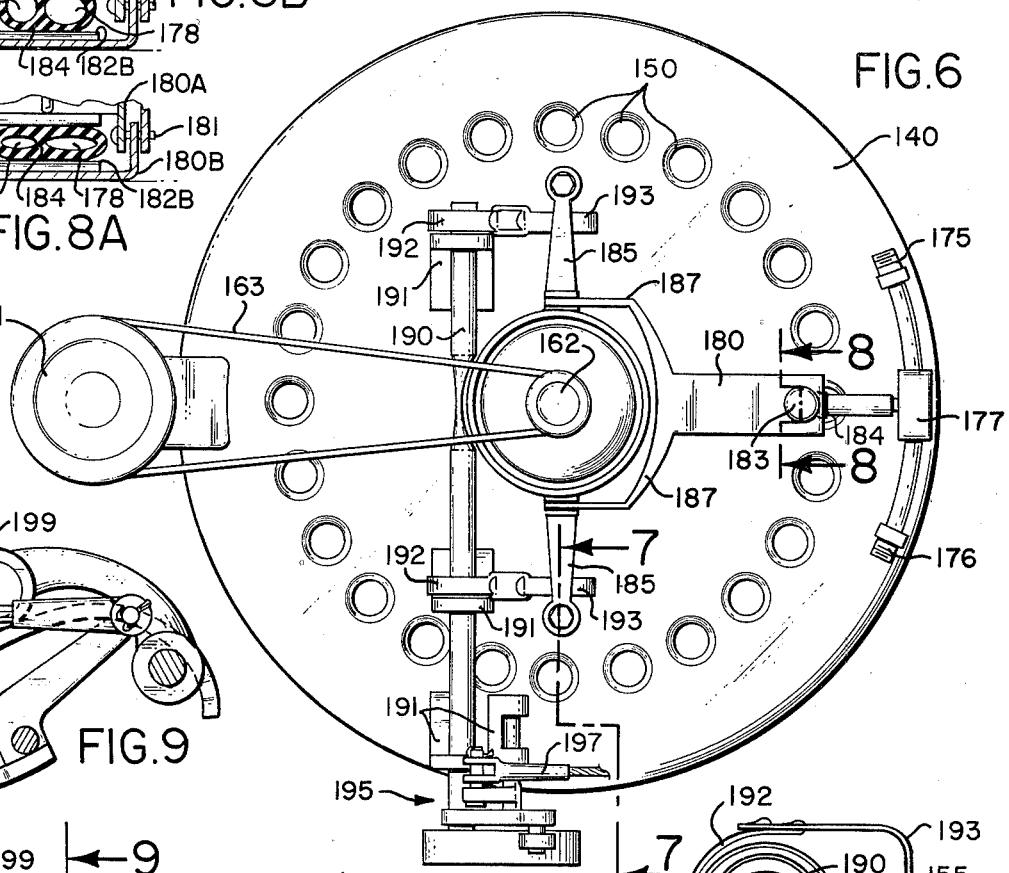
FIG. 6 is a plan view of the apparatus of FIG. 5.
Figure 9:
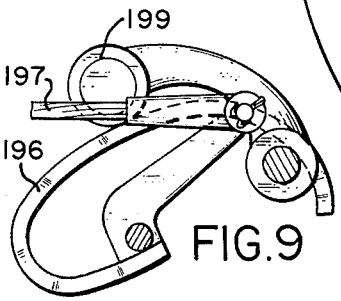
FIG. 9 is a view taken along the line 9—9 of FIG. 7.
Figure 10:
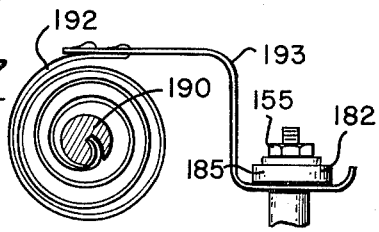
FIG. 10 is a view taken along the line 10—10 of FIG. 7.
Figure 7:
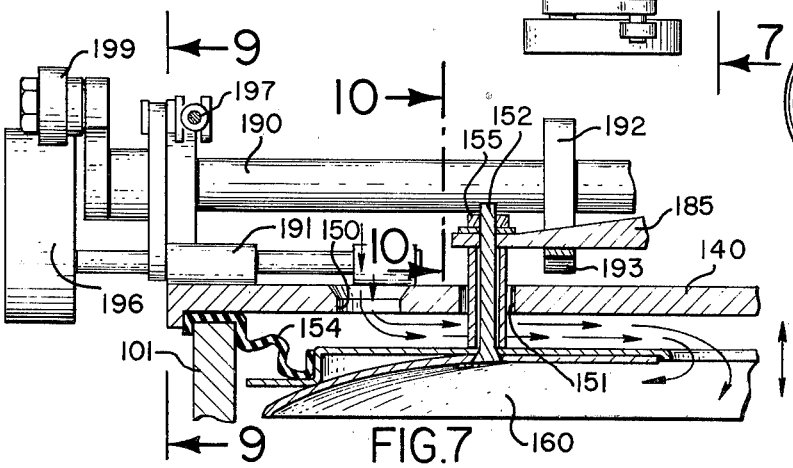
FIG. 7 is a view taken along the line 7—7 of FIG. 6.

As shown in FIGS. 5 and 6, the motor 104 is mounted on one side of the apparatus 100 preferably by being adjustably attached to the cover plate 140 so as to control belt tension. The motor 104 is preferably an electric motor which may be set at a desired constant speed. The motor 104 is connected to rotatably drive the rotor 102 by means of drive means formed by two pulley wheels 161 and 162 on an endless belt 163. The pulley wheel 161 is mounted on the output shaft of the motor 104 while the pulley wheel 162 is mounted on the upper end of the shaft 120. The endless belt 163 is preferably made of a material which is electrically non-conductive, such as a durable wear resistant elastomer material. Thus, since the rotor is electrically isolated from the other structure of the apparatus 100, by the insulative bearing "O" rings 118 and 145, the electric motor-rotor arrangement functions like a Van de Graaf electrostatic generator in which charge is continuously transferred to the rotor 102 by the non-conductive belt 163.

In the apparatus 100, fuel, water and/or other suitable additives are delivered to the liquid receiving chamber 119 of the upper rotor portion 121 through a delivery tube 170. The delivery tube 170 extends downwardly into the chamber 119 alongside of but not in contact with the rotor shaft 120 to a point adjacent to the flange 131. As above-mentioned, the flange 131 is preferably formed to slope on its upper surface downwardly from the shaft 120. Intersecting the outer edge of the flange 131 is the outwardly upwardly sloping conical wall portion 125. At or near the upper end of the surface 125, a plurality of holes 172, two of which are shown in FIG. 12, are formed therethrough. These holes 172 connect the liquid receiving chamber 119 in communication with the central cavity or centrifuge chamber 173 of the rotor 102. The cylindrical side wall of the centrifuge chamber 173 is formed by the stack of tightly pressed together nebulizer rings 124 which are held concentrically in place by the screen 123. It is noted that the holes 172 are sloped to direct fuel flowing therethrough onto the screen 123.

Figure 8B:
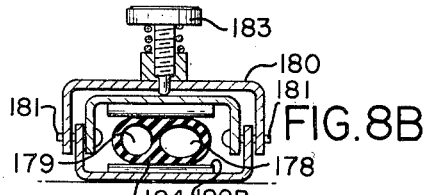
FIG. 8A and 8B are views taken along the line 8—8 of FIG. 6.
Figure 8A:
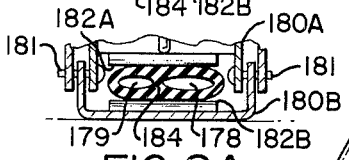

Two supply tubes or lines are illustrated, for supplying liquids to be nebulized to the apparatus 100. They are identified by the numerals 175 and 176. Supply line 175 is connected to a fuel source; e.g., the fuel pump of the internal combustion engine (not shown), while the supply line 176 is connected to a source of pressurized water. The tubes or holes 175 and 176 are coupled to a pinch valve junction box 177. The junction box 177 has two output channels 178 and 179 which are connected in communication with the tubes 175 and 176, respectively. These channels 178 and 179 are formed in a flexible tube 184 which may be constricted by being pinched to control the flow therethrough. FIG. 8B shows the channels 178 and 179 when unpinched to allow the full flow of fluid therethrough. The channel 178 through which fuel is supplied is illustrated as being oval shaped with the same height as the channel 179 but approximately twice the cross sectional area. In FIG. 8A, the channels are illustrated having their heights equally constricted. By equally constricting the heights of the channels 178 and 179, the ratio of fuel to water supplied to the delivery tube 170 may be maintained substantially constant.

Associated with the flexible tube 184 is a pinch valve mechanism made up of an arm 180 having fitted therein upper and lower pinch valve members 180A and 180B. The valve member 180B is secured on the upper surface of the cover plate 140 and provides a pivot mount. Pins 181 pivotally mounts the arm 180 and valve member 180A on the lower valve member 180B. The valve members 180A and 180B have cooperating parallel edge portions 182A and 182B for equally pinching the channels 178 and 179 when the edge portion 182A moves downwardly into contact with the tube 184. An adjustable idle screw 183 is threaded into the upper side of the arm 180 pushes downwardly against the upper valve member 180A to set the rate of fuel flow when the associated engine is idling. The output ends of the channels 178 and 179 of the tube 184 are connected in common communication with the delivery tube 170. As above-mentioned, the delivery tube 170 extends into the liquid receiving chamber 119 in the upper portion of the rotor 102. An exploded view of the above-described pinch valve arrangement is shown in FIG. 14.

The inner end of the pinch valve arm 180 is pivotally connected by arm members 187 to crossbar arms 185. The arms 185 are formed as extensions of a ring 186. The ring 186 is positioned around the upper end of rotor shaft 120 and the bearing means 144 associated therewith. The outer ends of the arms 185 are connected to the vertical extending guide posts 152 on the air impact diaphragm plate 153, preferably by forming holes therein through which the posts 152 extend and threading nuts 155 on the post ends.

Also mounted on the cover plate 140 is a shaft 190. The shaft 190 is positioned in a position parallel with the arms 185 by mounting it rotatably in spaced-apart journal bearing mounts 191. Coil springs 192 are coiled around the shaft 190 and have their inner ends affixed thereto. The other end of the coil springs 192 have arms 193 connected to extend therefrom which are positioned under the crossbar arms 185. Thereby, the coil springs 192 function to bias the crossbar arms 185 upwardly and thus place a controlled upward resilient biasing force on the air impact diaphragm 151.

Associated with the shaft 190 is cam means 195 which operates to control the bias force applied by the springs 192 to the arms 185. The cam means 195 are made up of an arcuate cam surface 196 pivotally mounted on the cover plate 140 adjacent one end of the shaft 190. The angular position of the cam surface 196 is controlled by the position of the cord 197 which in turn is controlled like the butterfly valve 111 as a function of engine throttle position. Opening the engine throttle pulls the cord 197 to rotate the cam surface 196 clockwise as shown in FIG. 11.

Fixedly mounted on the shaft 190 to ride on the cam surface 196 is a roller 199. Thus, the position of the cam 196 controls the angular position of the shaft 190. As noted above, the angular position of the shaft 190 controls the tension applied by the coil springs 192 to the arms 185 which in turn controls the magnitude of the resilient bias force applied to the air flow control diaphragm plate 153. The cam surface 196 illustrated causes the resilient biasing force applied to the air impact diaphragm 153 to increase as the engine throttle is opened.

It is noted that the shape of the cam surface 196 determines the resilient biasing force applied by the springs 192 for selected engine throttle positions. Further, a linkage or other arrangement sensitive to rate of change of engine throttle position could be included for varying the length of cord 196 as function of rate of change of throttle position, thereby to prevent sudden changes in the magnitude of the resilient biasing force applied to the air impact diaphragm 153.

In operation of the apparatus 100, the electric motor 104 is energized to drive the nebulizer rotor 102 at a suitable rate of rotation, such as 3000–6000 r.p.m. Once the rotor 102 is up to speed, the engine associated with the apparatus 100 may be started by energizing its starter motor (not shown) and opening its throttle, to open the butterfly valve 111 to the cold engine fast idle position.

As the engine is turned over by its starter, a vacuum is drawn in the mixing chamber 101. As a result, a pressure differential is created across the impact diaphragm 153 which overcomes the resilient biasing force applied by the coil springs 192. The diaphragm 153 is thus displaced inwardly. The distance the diaphragm is displaced depends on the air pressure differential on the plate 153 and the magnitude of the resilient biasing force being applied by the coil springs 192.

As a consequence of the downward displacement of the impact diaphragm 153, air flows into the mixing chamber 101 and the pinch valve opens to supply fuel and water, if the water supply is valved open, to the liquid receiving chamber 119 of the rotor 102. In practice the water supply is usually turned off by a valve control arrangement not shown during start up, warm up and while driving around a city at low speeds. Once the engine is warmed up and substantial power is required, the water supply is valved open.

The liquid fuel and water delivered to the chamber 119 are forced by centrifugal force up the conical wall surface 125 until they reach holes 172. Upon reaching holes 172, the liquids are propelled through the holes 172 onto the cylindrical screen 123.

The screen 123 prevents the liquid fuel and water from passing therethrough until the liquids are moving at substantially the same speed as the rotor 102. At that instant, the liquids pass through the screen 123, are propelled by centrifugal force between the smooth laminae defined by the tightly pressed together stack of nebulizer rings 124, and are thrown from the outer edges of the stack of rings 124 into the mixing chamber 101 as nebulized uniformly sized droplets which substantially homogeneously distribute themselves in the air flowing therethrough.

It is noted that it is believed that the nebulized droplets of uniform size which are formed by the action of the rotor 102 of the present invention result due to an interaction of the following forces on the liquids as they exit the smooth tightly pressed together laminae defined by the nebulizer rings 124: (1) liquid surface tension, (2) centrifugal force, and (3) the repulsion forces of the static charges picked up by the liquids as they are propelled between the nebulizer rings.

Thus, the fuel feeding device 100 operates to produce a substantially homogenous fuel and air metered mixture which then passes as very fine fog through the butterfly valve 111 to the intake manifold of the associated internal combustion engine.

It is noted that in operation of the subject fuel feeding device 100, engine throttle position controls the vacuum drawn in the mixing bowl 101 and the resilient biasing force applied to the impact diaphragm 153. Consequently, it is apparent that the rate air is supplied to the mixing bowl 101 is determined by and a function of engine throttle position, together with the absolute pressure within the mixing bowl 101. Additionally, it is noted that while the air flow through the device 100 is directly proportional to the amount of vacuum drawn in the bowl 101 that this air rate is indirectly proportional to the magnitude of the resilient biasing force applied to the impact diaphragm 153. Further, since air flow rate and the rate fuel and water are supplied to the device 100 are controlled as a function of the diistance the impact diaphragm 153 is displaced, it is evident that the rate which the fuel and water are supplied is directly proportional to the air flow through the device 100.

Further, it is noted that for maximum engine power that a richer mixture is required. This is accomplished in the exemplary device 100 by shaping the throttle actuated cam 196 to increase the tension on springs 192 as the throttle is opened. As a consequence, airflow through the diaphragm 153 increases at a slower rate than the fuel supply rate so that the air to fuel ratio in the mixing bowl 101 decrease towards stoichiometric as the throttle opens. It is remarked that with conventional carburetion and its accompanying wet intake manifold, substantially richer than stoichiometric air-fuel ratios are required.

With regard to the stack of nebulizer rings 124, it has been found preferable to form the rings of different dielectric materials alternately stacked one adjacent to the other, such as by the alternate stacking of the plastic paper type materials glassine and polyethylene terepthalate (mylar). The advantage of the use of alternately stacked dielectric materials of this type is that they cut cleanly when stacked together. Further, as hereinbefore noted, the use of dielectric materials has been found to increase the electrostatic charge generated on the nebulized droplets. The electrostatic charge effect, which causes the nebulized droplets to repulse each other and hence homogenously distribute themselves, is also believed to be enhanced by the Van de Graaf generator arrangement used to drive the rotor 102.

Thus, the method of nebulizing liquids to suspend them as nebulized droplets in a confined quantity of gas has been disclosed wherein the liquids are propelled by the use of centrifugal force between layers of pliable material which are tightly pressed together to form smooth laminae. At least alternate layers of the materials are preferably dielectrics. Such a method of nebulizing liquids has been found extremely efficient, and capable of rapidly handling large quantities of the liquids.

A nebulizer constructed substantially like the device 100 described herein has been tested with four different automobile engines. This testing has demonstrated that the engines tested could be operated on fuels having octane levels lower than that recommended by the manufacturers using very lean mixtures to achieve relatively high gasoline mileages. The automobile engines tested were a 1960 Chevrolet six cylinder engine having a displacement of 235.5 cubic inches and an 8.25 compression ratio; a Dodge Dart six cylinder engine having a displacement of 225 cubic inches and an 8.4 compression ratio; a Ford Thunderbird V8 engine having a displacement of 390 cubic inches and a 10.1 compression ratio; and a 1965 Lincoln V8 engine having a displacement of 430 cubic inches and a 10.1 compression ratio. The Thunderbird and Lincoln engines were run on an approved emissions laboratory chassis dynamometer and the air fuel ratios calculated from the emissions balance were 22.5 and 25.1, respectively. Road mileage tests over several tankfuls of regular grade gasoline before and after change from the factory carburetor to the nebulizer of the present invention yielded the following increases in mileage: for the Lincoln, an increase from 9.75 to 15.1 miles per gallon; and, for the Thunderbird, an increase from 13.0 to 20.6 miles per gallon. These mileage tests conducted were on the basis of tests equivalent to trips of over 500 miles.

With regard to the nebulizing of water with the nebulized fuel-air mixture produced by the nebulizer apparatus described herein, the following points are noted. Any water added to the combustion process takes heat from the burning fuel. The heat evaporates and superheats the water into steam. This heat is lost out the exhaust. Thus, if there is to be a benefit, it should change the burning process to make it more efficient and more than overcome the heat loss. Generally this can only be done at higher speed and loads, where the superheated steam appears to have a beneficial pressure effect upon the piston during the expansion stroke. Therefore, when small amounts of fuel are used, such as at idling and low car speeds and in colder weather, no water should be used. Also, it is noted that antifreeze, i.e. an alcohol, should be added to the water to prevent ice from forming in the water supply tank. The addition of antifreeze has the benefit of adding energy to the fuel mixture which functions to improve engine power and cleaner combustion.

Further, it is pointed out that the addition of water operates to reduce the peak temperature of the flame of combustion so as to reduce the formation of the pollutant the oxides of nitrogen. With the lean mixture burned by a nebulizer constructed in accordance with the present invention, however, very little water if any need be used to eliminate this pollutant. The addition of water to the nebulized fuel mixture also, though, has the advantage of functioning to remove combustion chamber deposits.

Although I have herein shown and described my invention in what I have conceived to be the most practical and preferred embodiments, it is recognized that departures may be made therefrom within the scope of my invention. It is also noted that the invention described herein is suitable for incorporation into fuel feeding systems of the type capable of sensing and adjusting for altitude, air temperature, manifold vacuum, engine speed, engine load, engine temperature and other operating conditions.

I claim:

1. Apparatus for producing a combustible fuel mixture for delivery to internal combustion engine or the like, comprising:

structure defining a mixing chamber, said mixing chamber having an outlet port;

hollow rotor means for nebulizing liquids, said rotor means being rotatably mounted within said mixing chamber and carrying a stack of nebulizer rings positioned one upon the other to define the outer wall of a centrifuge cavity, said nebulizer rings being made of pliant material characterized by having substantially constant dimensions and being held tightly pressed together to define a stack of smooth laminae, and wherein at least alternate ones of said nebulizer rings are made of different dielectric materials whereby liquids propelled between the laminae defined by said nebulizer rings are nebulized into uniformly sized droplets carrying electrostatic charges of substantial magnitude with the result that said nebulized droplets repel each other and tend to distribute themselves substantially homogenously throughout the gas in said mixing chamber and throughout the combustible fuel mixture delivered through the output port of said mixing chamber to an internal combustion engine or the like;

means connected in driving relationship with said rotor means for selectively rotating said rotor means at a selected rotation rate sufficient to nebulize liquids supplied to said centrifuge cavity; and means for supplying liquid fuel to said centrifuge cavity and a selected gas to said mixing chamber whereby the liquid fuel supplied to said centrifuge cavity is nebulized and uniformly interspersed as nebulized droplets in the selected gas supplied to said mixing chamber by being propelled by centrifugal force through the smooth laminae defined by said nebulizer rings.

2. The invention defined in claim 1, wherein said different dielectric materials comprise glassine and polyethylene terephthalate.

3. Apparatus for producing a combustible fuel mixture for delivery to internal combustion engines or the like, comprising:

structure defining a mixing chamber, said mixing chamber having an outlet port;

hollow rotor means for nebulizing liquids, said rotor means being rotatably mounted within said mixing chamber and carrying a stack of nebulizer rings positioned one upon the other to define the outer wall of a centrifuge cavity, said nebulizer rings being made of pliant material characterized by having substantially constant dimensions and being held tightly pressed together to define a stack of smooth laminae;

means connected in driving relationship with said rotor means for selectively rotating said rotor means at a selected rotation rate sufficient to nebulize liquids supplied to said centrifuge cavity, where said rotor means is electrically insulated from the remainder of said apparatus, and said rotor means and means connected in driving relationship therewith form a Van de Graaf generator in which electrostatic change is continuously conveyed to said rotor means as it is rotated by said driving means; and means for supplying liquid fuel to said centrifuge cavity and a selected gas to said mixing chamber whereby the liquid fuel supplied to said centrifuge cavity is nebulized and uniformly interspersed as nebulized droplets in the selected gas supplied to said mixing chamber by being propelled by centrifugal force through the smooth laminae defined by said nebulizer rings.

4. The invention defined in claim 3 wherein said driving means comprises an electric motor connected to drive said rotor means through an endless belt of nonconductive material.

5. Apparatus for producing a combustible fuel mixture for delivery to internal combustion engines or the like, comprising:

structure defining a mixing chamber, said mixing chamber having an outlet port;

hollow rotor means for nebulizng liquids, said rotor means being rotatably mounted within said mixing chamber and carrying a stack of nebulizer rings positioned one upon the other to define the outer wall of a centrifuge cavity, said nebulizer rings being made of pliant material characterized by having substantially constant dimensions and being held tightly pressed together to define a stack of smooth laminae;

means connected in driving relationship with said rotor means for selectively rotating said rotor means at a selected rotation rate sufficient to nebulize liquids supplied to said centrifuge cavity; and means for supplying liquid fuel to said centrifuge cavity and a selected gas to said mixing chamber whereby the liquid fuel supplied to said centrifuge cavity is nebulized and uniformly interspersed as nebulized droplets in the selected gas supplied to said mixing chamber by being propelled by centrifugal force through the smooth laminae defined by said nebulizer rings, said means for supplying fuel to said centrifuge cavity and a selected gas to said mixing chamber is operable to control the rate of fuel supply as a function of the supply rate of the selected gas where the selected gas is the atmosphere in which the said apparatus is operating, and said means for controlling the flow of said gas into said mixing bowl is impact diaphragm means, said impact diaphragm means being resiliently biased closed and responsive to the pressure differential between the interior of said mixing bowl and the outside atmosphere to open and permit airflow into said mixing bowl as a function of the magnitude of said pressure differential; and means for controlling the resilient bias force applied to said impact diaphragm means as a function of the throttle position of an associated engine to which a fuel mixture is being supplied wherein said means for controlling the resilient bias force applied to said impact diaphragm means comprises:

rotatable shaft means;

cams means connecting said rotatable shaft means with the throttle of the associated engine for controlling the angular position of said shaft means as a function of throttle position; and spring means including coil springs coupling said rotatable shaft means with said impact diaphragm means, said coil springs being coiled around said rotatable shaft means and having its inner end attached thereto whereby the angular position of said rotatable shaft means determines the resilient biasing force applied to said impact diaphragm means.

6. Apparatus for producing a combustible fuel mixture for delivery to internal combustion engines or the like, comprising:

structure defining a mixing chamber, said mixing chamber having an outlet port;

hollow rotor means for nebulizing liquids, said rotor means being rotatably mounted within said mixing chamber and carrying a stack of nebulizer rings positioned one upon the other to define the outer wall of a centrifuge cavity, said nebulizer rings being made of pliant material characterized by having substantially constant dimensions and being held tightly pressed together to define a stack of smooth laminae;

said hollow rotor means includes cylindrical screen means fixedly secured therein for holding said nebulizer rings substantially concentric with the axis of rotation of said rotor means and controlling the feeding of liquids in said centrifuge chamber thereto whereby the liquid to be nebulized is only fed to the stack of laminae defined by said nebulizing rings when it has been brought up to the speed of rotation of said rotor means;

said rotor means is comprised of upper and lower portions between which are sandwiched said stack of nebulizer rings, said upper rotor portion having a liquid receiving chamber defined therein above said centrifuge chamber which slopes outwardly and upwardly from the axis of rotation of said rotor means to define a conical surface therearound, said upper rotor portion having at least one outwardly and downwardly sloping channel connecting said liquid receiving chamber in communication with said centrifuge chamber and sloped to direct liquid flowing therethrough towards said cylindrical screen means;

means connected in driving relationship with said rotor means for selectively rotating said rotor means at a selected rotation rate sufficient to nebulize liquids supplied to said centrifuge cavity; and means for supplying liquid fuel to said centrifuge cavity and a selected gas to said mixing chamber whereby the liquid fuel supplied to said centrifuge cavity is nebulized and uniformly interspersed as nebulized droplets in the selected gas supplied to said mixing chamber by being propelled by centrifugal force through the smooth laminae defined by said nebulizer rings; and said means supplying liquid fuel to said centrifuge cavity includes said upper rotor portion, a delivery tube for delivering liquid to said liquid receiving chamber, a fuel line and valve means connecting said fuel line in communication with said delivery tube.

7. The invention defined in claim 6, wherein said valve means includes a flexible tube having at least one channel defined therein and pinch valve means, said one channel being connected between said delivery tube and fuel line, said pinch valve means being operable to constrict said flexible tube to control the flow of fuel through said channel as a function of the rate said selected gas is supplied to said mixing chamber.

8. The invention defined in claim 7, including at least one other channel formed through said flexible tube, said other channel communicating with said delivery tube so that water, selected other additives or fuels may be supplied therethrough to said rotor means.

9. A nebulizer rotor, comprising rotor structure carrying a stack of nebulizer rings positioned one upon the other to define the outer wall of a centrifuge cavity, said nebulizer rings being made up of pliant material characterized by having substantially constant dimensions and being held tightly pressed together to define a stack of smooth laminae whereby liquid supplied to said centrifuge cavity may be nebulized by rotating said rotor at a sufficient rotation rate to propel it by centrifugal force through the smooth laminae defined by said nebulizer rings, wherein at least alternate ones of said nebulizer rings are made of dielectric materials to impart substantial electrostatic charge to liquids propelled between the laminae defined thereby, and where said stack of nebulizer rings is made up of alternate layers of glassine and polyethylene terephthalate.

10. A nebulizer rotor, comprising rotor structure carrying a stack of nebulizer rings positioned one upon the other to define the outer wall of a centrifuge cavity, said nebulizer rings being made up of pliant material characterized by having substantially constant dimensions and being held tightly pressed together to define a stack of smooth laminae whereby liquid supplied to said centrifuge cavity may be nebulized by rotating said rotor at a sufficient rotation rate to propel it by centrifugal force through the smooth laminae defined by said nebulizer rings;

said rotor includes a cylindrical screen mounted withinn said rotor structure to hold said nebulizer rings substantially concentric with the axis of rotation of said rotor means and control the feed of liquids thereto; and said rotor structure is comprised of upper and lower portions between which are sandwiched said stack of nebulizer rings, said upper rotor portion having a liquid receiving chamber defined therein above said centrifuge chamber which slopes outwardly and upwardly from the axis of rotation of said rotor means to define a conical surface therearound, said upper rotor portion having at least one outwardly and downwardly sloping channel connecting said liquid receiving chamber in communication with said centrifuge chamber and sloped to direct liquid flowing therethrough towards said cylindrical screen.

* * * * *